US010510217B1

(12) United States Patent
Klinghoffer et al.

(10) Patent No.: US 10,510,217 B1
(45) Date of Patent: Dec. 17, 2019

(54) GAME SYSTEM AND METHOD WITH FINAL HAND DESIGNATION FEATURE

(71) Applicants: Steven Klinghoffer, Sherwood Forest, CA (US); Neil Monastersky, Warwick, NY (US)

(72) Inventors: Steven Klinghoffer, Sherwood Forest, CA (US); Neil Monastersky, Warwick, NY (US)

( * ) Notice: Subject to any disclaimer, the term of this patent is extended or adjusted under 35 U.S.C. 154(b) by 0 days.

(21) Appl. No.: 16/024,568

(22) Filed: Jun. 29, 2018

(51) Int. Cl.
*G07F 17/32* (2006.01)

(52) U.S. Cl.
CPC ..... *G07F 17/3293* (2013.01); *G07F 17/3211* (2013.01)

(58) Field of Classification Search
None
See application file for complete search history.

(56) References Cited

U.S. PATENT DOCUMENTS 8,137,174 B2 * 3/2012 Nicely ..... G07F 17/32 273/138.1
9,452,346 B2 * 9/2016 Grauzer ..... A63F 1/18
2015/0221182 A1 * 8/2015 Denenberg ..... G07F 17/3293 463/11

* cited by examiner

*Primary Examiner* — Ronald Laneau
(74) *Attorney, Agent, or Firm* — Newman Law, LLC

(57) ABSTRACT

A game method and system involving distributing a plurality of cards to participating players, receiving player selections to divide the cards into a plurality of final hands with each final hand being associated by the player with a preset designation, comparing the ranks of the final hands to determine a point total for each player and awarding an additional amount of points to each player having the highest ranked hand of any player for each of the preset designations.

3 Claims, 7 Drawing Sheets

GAME SYSTEM AND METHOD WITH FINAL HAND DESIGNATION FEATURE

BACKGROUND OF THE INVENTION

Field of the Invention

The present invention relates to the field of gaming, particularly to the field of games involving random gaming implements, such as cards, and more particularly to modified and unique games for play by multiple players.

Background of the Art

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

SUMMARY OF THE INVENTION

Some embodiments of the invention are directed to systems and methods for providing a game at a gaming table or virtually online involving distributing a plurality of cards to participating players, receiving player selections to divide the cards into a plurality of final hands with each final hand being associated by the player with a preset designation, comparing the ranks of the final hands to determine a point total for each player and awarding an additional amount of points to each player having the highest ranked hand of any player for each of the preset designations.

Some embodiments of the invention are directed to a system for providing a game at a gaming table, the system including one or more processors, display devices, data input devices, and memory, wherein the display device displays a gaming table layout with a plurality of defined areas, the processor being configured to simulate a custom set of randomly-ordered physical playing cards having a plurality of unique wild cards, wherein executable code in memory is executed to perform the following steps: display cards from the set of playing cards to form an initial player hand for each participating player; receive a selection of a plurality of final hands and a hand designation from each player for each final hand of the plurality, each final hand of the plurality comprising at least two cards from the initial player hand and each hand designation being a unique and single designation selected from a preset group of designations, wherein each player's final hands are associated with a single respective hand designation included in the preset group of designations; determine the rank of each player's final hand; compare each player's final hand with a preset point chart based on the determined rank of each final hand; compare each player's final hand rank with at least one other player's final hand rank of the same designation, wherein the player having the final hand that is of the highest rank in any designation is identified as the winner of the designation; and assign a point total for each player based on the comparison of each player's final hand with the preset point chart, wherein each player receives an additional amount of points responsive to being identified as the winner of the designation. In some embodiments, the ranking for comparison sake is based on poker ranks.

Some embodiments of the invention are directed to a method of providing a game comprising the steps of: providing a gaming table layout with a plurality of defined areas representing final hand designations in the game; providing a custom deck of cards including a standard deck of cards and a plurality of wild cards; distributing cards from the set of playing cards to form an initial player hand for each participating player; receiving a selection of a plurality of final hands and a hand designation from each player for each final hand of the plurality, each final hand of the plurality comprising at least two cards from the initial player hand and each hand designation being a unique and single designation selected from a preset group of designations, wherein each player's final hands are associated with a single respective hand designation included in the preset group of designations; determining the rank of each player's final hand; comparing each player's final hand with a preset point chart based on the determined rank of each final hand; comparing each player's final hand rank with at least one other player's final hand rank of the same designation, wherein the player having the final hand that is of the highest rank in any designation is identified as the winner of the designation; and assigning a point total for each player based on the comparison of each player's final hand with the preset point chart, wherein each player receives an additional amount of points responsive to being identified as the winner of the designation.

In some embodiments, each final hand consists of the same amount of cards and together includes all of the cards distributed to form the initial hand.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION OF SOME EMBODIMENTS OF THE INVENTION

It should be understood that the invention is generally directed to systems, methods and apparatus for providing, operating, hosting and conducting interactive games generally involving sequences of controlled and concrete transformative events or steps, the generation of random results or data, and the use and application of the randomly generated results in a manner which provides for the resolution of both prior and/or subsequent events or steps.

In the exemplary embodiments disclosed herein, the invention includes various steps such as those involving the acceptance of players for a game, which may include receiving fees or wagers, provision of randomly generated gaming implements, distribution of the gaming implements according to preset formations and procedures, comparison of one or more of such formations with preset criteria, determining the outcome of the game and then assigning winning results depending on the determined outcome.

It should be understood that the words "wager," "wagering," "betting" or "bet," or the like, refers to any type of points, money, credits, items of value, including physical or virtual representations thereof, which are placed at risk in that they may be forfeit depending on the occurrence and application of randomly generated data. Additionally, it should also be understood that gaming implements may include standard or customized playing cards, joker cards and customized joker or other unique cards, and may be provided in a physical form, such as a set of randomly-ordered group of shuffled cards, or in a virtual form, such as a display device operatively associated with a processing device, memory and random number generator for creating a depiction of a gaming implement on the display device and generating random results to simulate the random results of physical gaming implements.

Each of the methods and individual steps recited herein may be partially or wholly carried out in a variety of ways and/or systems, which may include, but are not limited to, a live dealer physically dealing or using gaming implements in a casino, an electronic gaming machine (EGM) or kiosk for one or more players in which a live dealer distributes or uses gaming implements, such as cards, which may be in combination with a mechanism such as a camera or sensors for determining game outcomes by processing the random results with a data processor, or gaming implements are provided through a program which may include a random number generator, standalone multiplayer platforms which may include a player interface such as a touchscreen display and a physical or virtual gaming implements, through a home computer or portable computing device, such as a tablet computer or mobile phone capable of communicating with a network or over the Internet, global telecommunication network or world wide web.

Figure 1:
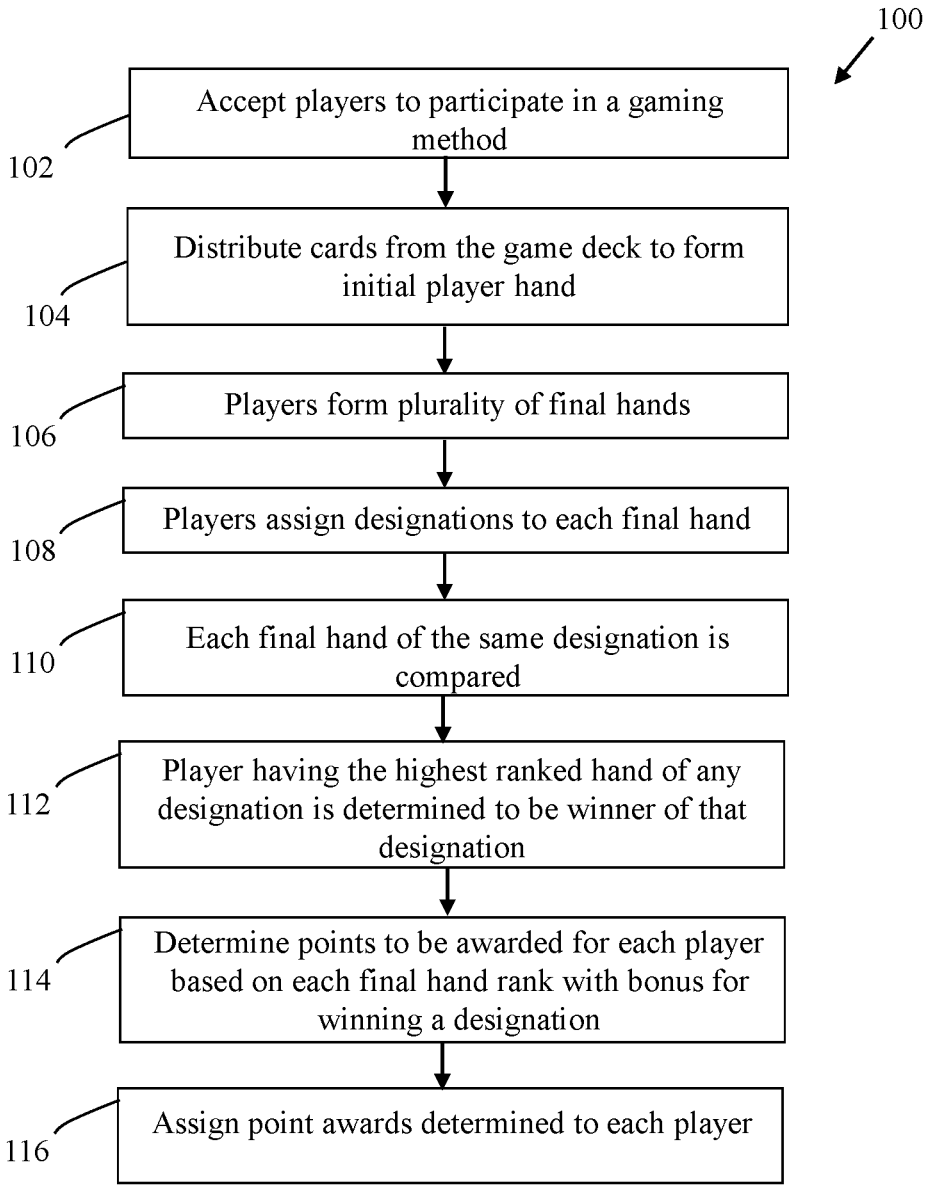
FIG. 1 is a process flow chart depicting an exemplary method for conducting a game configured and constructed according to some embodiments of the invention.

FIG. 1 provides an exemplary embodiment of the invention for providing a gaming method generally referred to by the reference numeral 100. In this embodiment, the gaming method of the invention involves players competing against one another. In other embodiments, players may compete against one another and/or a dealer. Additionally, in this embodiment, players compete against one another by forming and comparing hands based on poker rules and hierarchy. It should be understood that the competition between players may be based on other rules, such as for example, blackjack rules.

In step 102, a player is accepted to participate in gaming method 100. In some embodiments, this step may further include receiving a game wager or fee from each player. For purposes of such embodiments, receiving a wager or fee generally involves the positioning of physical elements which represent monetary amounts (e.g., tokens or chips) in a designated area on the surface of a physical gaming table prior to the distribution or random generation of playing cards in the underlying game. The gaming table surface may include various areas designated thereon for placing wagers and for placing physical cards distributed to form the initial and final player hands.

In this embodiment, the game deck of cards is a custom deck of fifty-two card standard physical playing cards plus eight additional physical playing cards that will be wild cards in the game are randomized and provided for use in gaming method 100. In other embodiments, one or more of these customized decks are the game deck or one or more standard decks are provided for use as the game deck. It should be readily apparent that more, less or no wild cards may be included in the game deck in other embodiments. The game deck may be hand-shuffled or shuffled via a card shuffling device.

In step 104, cards from the game deck are distributed to each player (and/or dealer, if any, in other embodiments) participating in the game provided by gaming method 100. In this embodiment fifteen cards are distributed to each player to form the player's initial hand.

In step 106, each participating player selects cards from the initial hand to form a plurality of final hands. In this embodiment, the player forms three final hands. In other embodiments, players may form more or less final hands. Preferably, a player forms three final hands of the highest ranking according to the game rules as possible. Thus, in this embodiment, players will form the three highest poker ranking hands as possible from the cards distributed to form the player's initial hand.

In step 108, each player assigns a designation for each final hand of the plurality of final hands for comparison sake with each other player's similarly designated final hands. In this embodiment, each player will assign which of the three final hands is their A hand, B hand and C hand, respectively. In this embodiment, players may freely assign each designation, and no hierarchy of hands between the assignment is required, that is, A may be higher or lower ranked or the same rank as B and/or C. This step is shown as an independent step for illustrative purposes but it should be understood that this step may be combined with the prior step of selecting cards such that players select cards from the initial hand to form each designated hand in the same step.

As shown by step 110, each player's final hand of the same designation is revealed and compared with another player's final hands to determine the higher ranked hand. In step 112, the player having the higher ranked hand is determined to be the winner of that designation or group.

In step 114, each player's final hands are compared with a preset point chart for assigning points based on poker rankings and then the total is awarded to the player. Any winning players determined in step 112 receive a bonus of additional points for each designation won. An exemplary point chart table showing the points awarded for each hand rank and the bonus points for winning a designation is provided below in Table 1.

TABLE 1

| Poker Rank (A, B or C) | Points |
|---|---|
| 5 of a Kind | 10 |
| Straight Flush | 9 |
| 4 of a Kind | 8 |
| Full House | 7 |
| Flush | 6 |
| Straight | 5 |
| 3 of a Kind | 4 |
| 2 Pair | 3 |

TABLE 1-continued

| Poker Rank (A, B or C) | Points |
|---|---|
| 1 Pair | 2 |
| High Card | 1 |
| Bonus for Winning a Designation | 5 |

It should be understood that 5 of a Kind is only available in gaming methods of the invention which include at least one wild card. As show by step 116, the point total determined in step 114 is assigned to each player. As players accumulate points the game provided by gaming method 100 may be won by the player achieving a preset point total after one or more hands of the gaming method 100.

In some embodiments, players may receive portions of a main or side pot of collected wagers or other payouts based on one or both of the poker rankings and winning designations.

Figure 2:
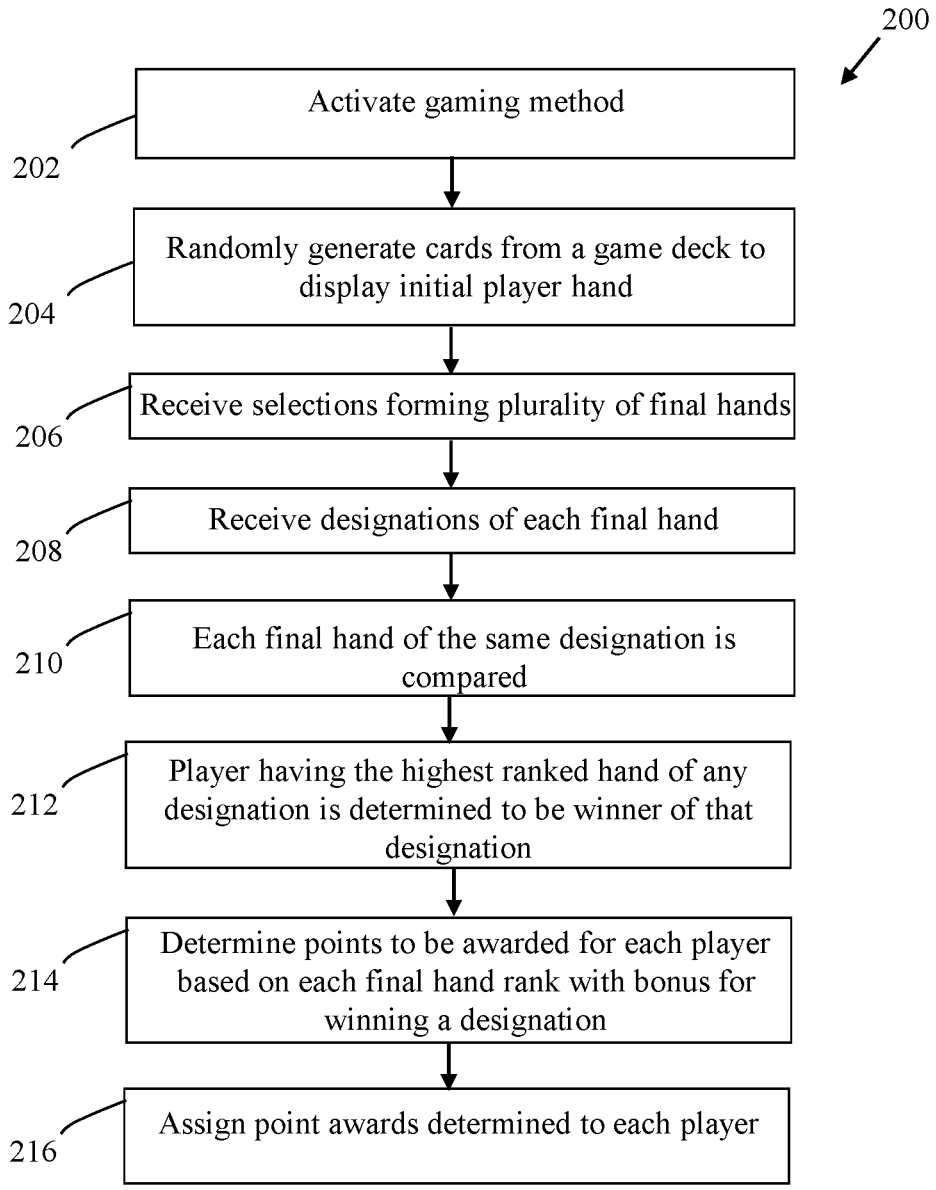
FIG. 2 is a process flow chart depicting another exemplary method for conducting a game configured and constructed according to some embodiments of the invention.

FIG. 2 provides another exemplary embodiment of the invention for providing a gaming method generally referred to by the reference numeral 200. Gaming method 200 is provided electronically and may be implemented in accordance or in conjunction with one or more of a variety of different types of gaming systems, such as those described herein, including computer based platforms which may be specially configured for the provision of games, such as electronic player terminals, multiplayer platforms, electronic gaming machines, or other devices which are not specially configured for the provision of games, such as a smartphone, that can be enabled as a platform or device through which such features of the invention can be made accessible during game play. Embodiments of the invention therefore contemplate a variety of different gaming systems each having one or more of a plurality of different features, attributes, or characteristics as disclosed herein.

In step 202, gaming method 200 is activated. Activation may involve as a preliminary step the establishment of, or login to, a player account stored in a memory, the purchase of virtual credits or funding of the player account and an electronic transfer of funds or credits in order to activate the gaming method in step 202.

In step 204, cards or virtual depictions of an initial hand of cards from a simulated game deck are randomly generated for display on a display device for each player. The simulated game deck, such as the customized deck of cards as described above with respect to gaming method 100, may be stored in memory and accessed by a processing device in communication with a random number generator for the purpose of providing random cards to the participating player's device.

In steps 206 and 208, selections as to the final hands and assignment of designations for each final hand are received from the player through a data input device, such as a touchscreen or keypad operatively associated with a user device. In steps 210 and 212, a processing device determines the player having the highest ranked hands and the points to be awarded for each player. As shown in step 216, point awards are assigned to each player and may be displayed on a player's display device.

Figure 3:
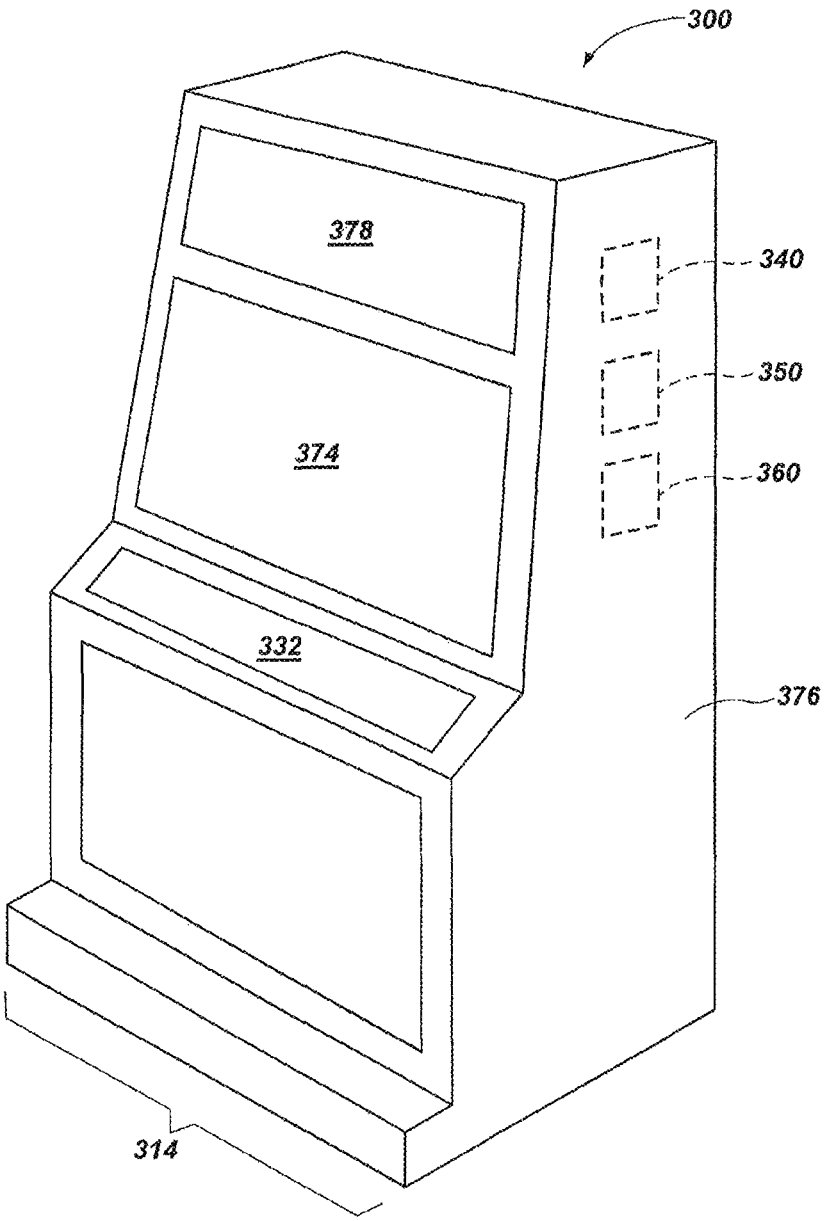
FIG. 3 is a perspective view of an individual electronic gaming device configured for implementation of embodiments of games in accordance with this disclosure.

FIG. 3 is a perspective view of an individual electronic gaming device 300 (e.g., an electronic gaming machine (EGM)) configured for implementing games, such as wagering games, according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical implements and live personnel. The action may instead be simulated by a control processor 350 operably coupled to the memory 340 and interacting with and controlling the individual electronic gaming device 300.

Figure 4:
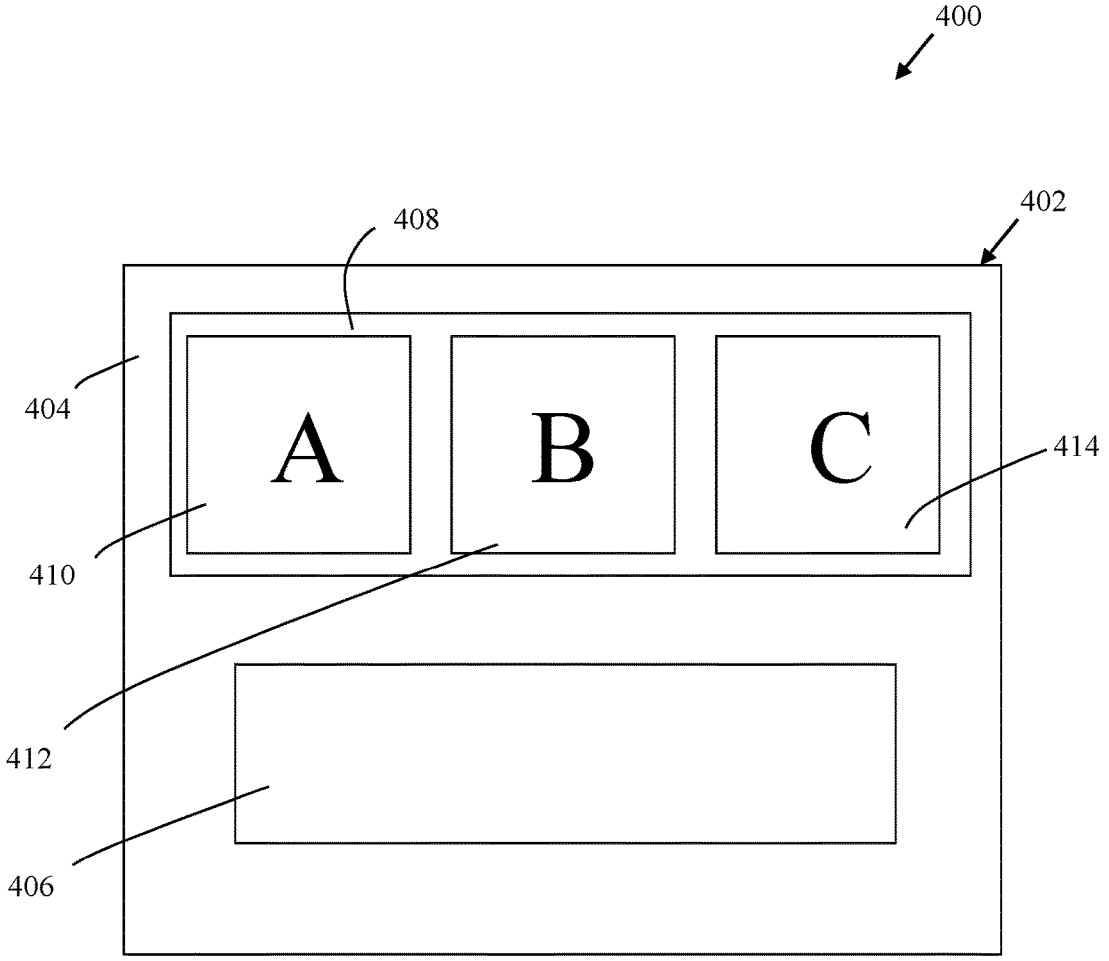
FIG. 4 is schematic diagram of a table layout configured for implementation of embodiments of games in accordance with this disclosure.

Although the individual electronic gaming device 300 displayed in FIG. 4 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices such as a server through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play.

Some embodiments may be implemented at locations including a plurality of player stations. Such player stations may include an electronic display screen for display of game information (e.g., animations and game instructions) and for accepting player information, wagers or fees and facilitating credit balance adjustments. Such player stations may, optionally, be integrated in a table format, may be distributed throughout a casino or other gaming site, or may include both grouped and distributed player stations.

In some embodiments, the games described herein may be played against a game administrator (i.e., against "the house" such that the game is "house-banked"). Such implementations may involve the game administrator (e.g., a casino or other gaming establishment) accepting (e.g., via a dealer or other agent of the administrator) wagers of real-world monetary value, distributing payouts of real-world monetary value on winning wagers to players, and collecting real-world monetary value of lost wagers.

In other embodiments, the games may involve a player vs one or more other players, and an administrator may collect a player entrance fee.

In some embodiments, players may play a head to head or tournament version utilizing the gaming methods as described herein wherein players compete against one another or others.

FIG. 4 illustrates an exemplary table layout 400, which may be physically provided on a table or provided for display on a display device. Layout 400 includes a surface area 402 having a player position 404 with an area 406 for receiving an initial hand and a final hand area 408 for dividing the initial hand into three designated final hands, hand A in area 410, hand B in area 412 and hand C in area 414. It should be understood that one or more player positions 404 may be provided on surface area 402. In operation of a gaming method of the invention, the initial hand is distributed to area 406 of each player position 404, players select the final hands and assign the designations for each by placing each final hand in a designated area, 410, 412 and 414, respectively.

Figure 5:
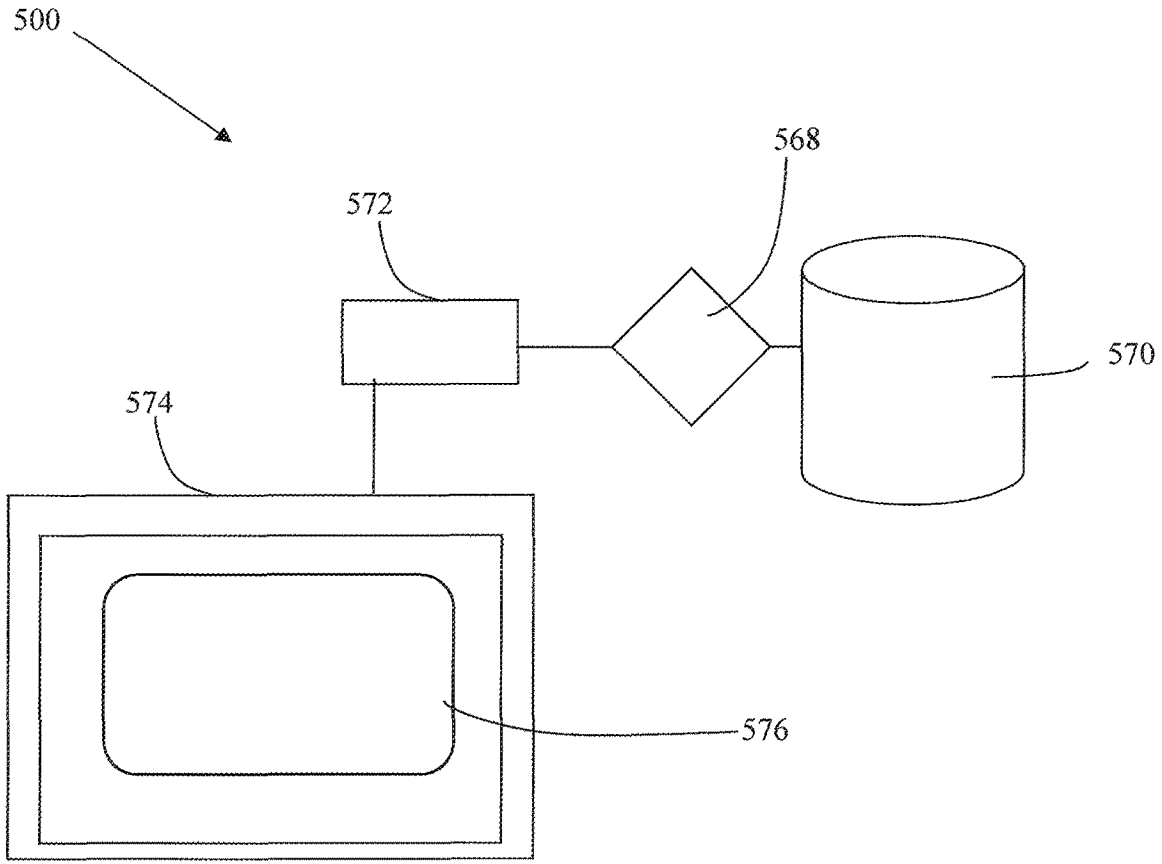
FIG. 5 is a schematic diagram depicting the components of an exemplary system configured and constructed according to some embodiments of the invention.

FIG. 5 illustrates a diagram of an exemplary system 500, which may be a portable device, constructed in accordance with some embodiments of the invention. System 500 includes processing device 568 in communication with a database or memory device 570, communication or data input/output device 572 and a display device 574. In some embodiments, display device 574 is a touch-enabled device and includes a data input device component. Memory device 570 may include data relating to the underlying game and embodiments of the invention as described herein, such as the game play, final hands, designations and point assignments. A player interface 576 can be presented on display device 574. Player interface 576 may be a virtual representation of an interface for facilitating game play in accordance with any of the embodiments herein. Game play and outcomes are displayed and tracked using display device 574 and processing device 568.

Figure 6:
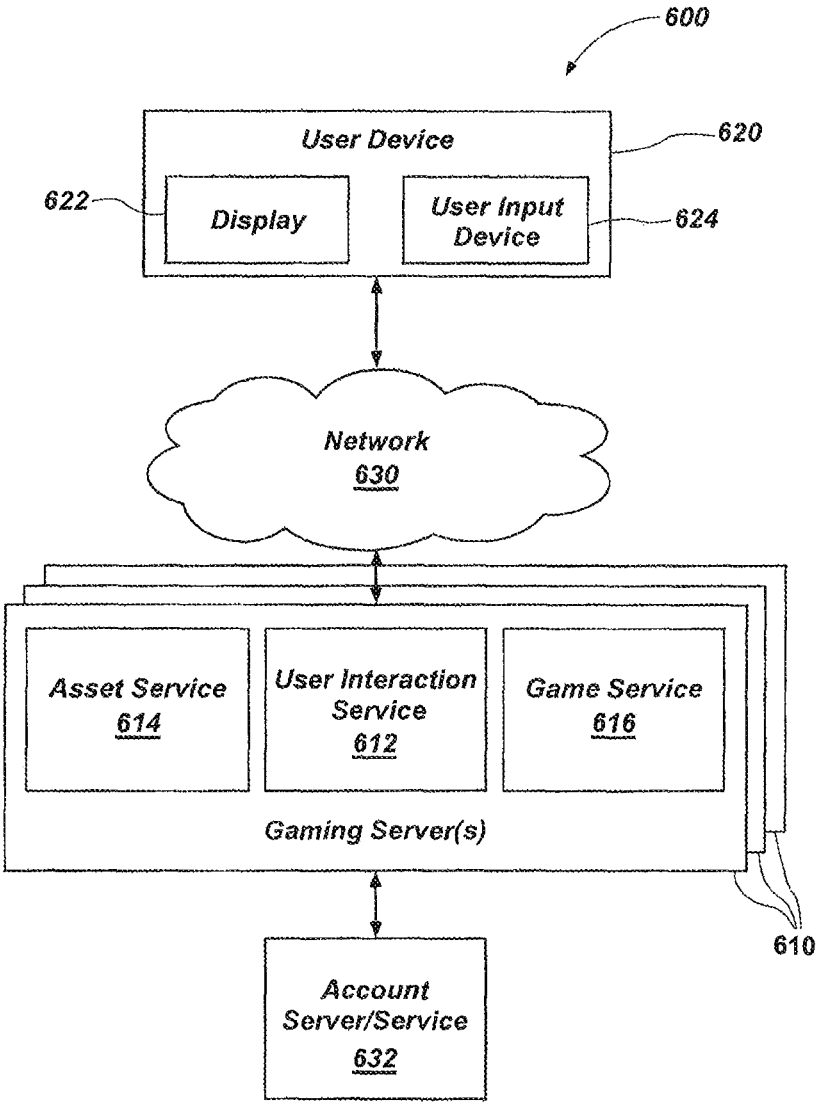
FIG. 6 is a schematic block diagram of a gaming system for implementing embodiments of waging games in accordance with this disclosure.

In some embodiments, games in accordance with this disclosure may be administered using a gaming system employing a client-server architecture (e.g., over the Internet, a local area network, etc.). FIG. 6 is a schematic block diagram of an exemplary gaming system 600 for implementing games of the invention so that end users may remotely access games as described herein, among others.

The games supported by the gaming system 600 may be operated with real currency or with virtual credits or other virtual (e.g., electronic) value indicia. For example, the real currency option may be used and currency cashed out at the end of a game session. The virtual credits option may be used with games of the invention in which credits may be issued to a player to be used for activating game play and/or placing wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit or point redemption restrictions may be applied to some or all of points or credits won in a game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated.

The gaming system 600 may include a gaming platform to establish a portal for an end user to access a game hosted by one or more gaming servers 610 over a network 630. In embodiments, games of the invention are accessed through a user interaction service 612. The gaming system 600 enables players to interact with a user device 620 through a user input device 624 and a display 622 and to communicate with one or more gaming servers 610 using a network 630 (e.g., the Internet). Typically the user device is remote from the gaming server 610 and the network is the word-wide web (i.e., internet).

In some embodiments, the gaming servers 610 may be configured as a single server to administer games in combination with the user device 620. In other embodiments, the gaming servers 610 may be configured as separate servers for performing separate, dedicated functions associated with administering games of the invention. Accordingly, the following description also discusses "services" with the understanding that the various services may be performed by different servers or combinations of servers in different embodiments. As shown in FIG. 6, the gaming servers 610 may include a user interaction service 612, a game service 616, and an asset service 614. In some embodiments, one or more of the gaming servers 610 may communicate with an account server 632 performing an account service 632. As explained more fully below, for some games disclosed herein, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may comprise game rules, such as those relating to the final hand designations, comparisons and point assignments based on final hand ranks. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script, also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of games.

The gaming servers 610 may include the game service 616, which may be programmed to administer games and determine game play outcomes to provide to the user interaction service 612 for transmission to the user device 620. For example, the game service 616 may include game rules for one or more games, such that the game service 616 controls some or all of the game flow for a selected game as well as the determined game outcomes. The game service 616 may include pay tables and other game logic. The game service 616 may perform random number generation for determining random game elements of any game of the invention, such as game 102. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 400 (see FIG. 4) or portable system 500 (see FIG. 6), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers, fees or issue payouts. That is, the gaming servers 610 may facilitate online gaming but may not be part of a self-contained online game operator itself. Another entity (e.g., an operator or any account holder or financial system of record) may operate and maintain its external account service 632 to accept wagers or fees and make payout distributions. The gaming servers 610 may communicate with the account service 632 to verify the existence of funds as needed and to instruct the account service 632 to execute debits and credits. As another example, the gaming servers 610 may directly accept wagers and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations.

Figure 7:
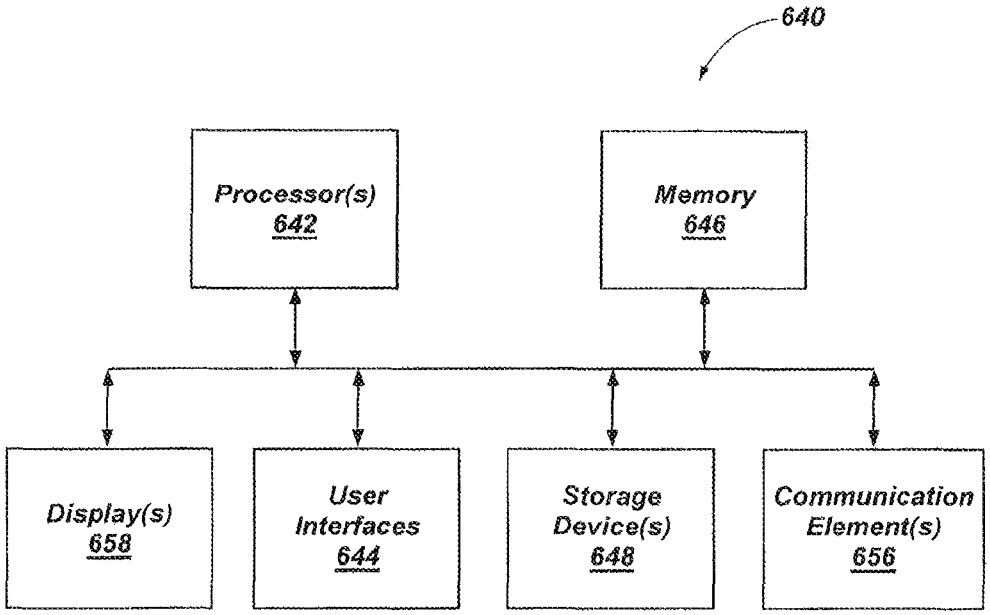
FIG. 7 is a schematic block diagram of a gaming system for implementing embodiments of games including a live dealer feed.

FIG. 7 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering games of the present disclosure.

The memory 646 may be used to hold computing instructions, data, and other information for performing a wide variety of tasks including administering games of the invention, such as game 102. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Additional information regarding exemplary embodiments of the invention is provided below.

Computer Program

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™ and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous Javascript and XML (AJAX), Flash® Actionscript, Javascript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

Mobile Application

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

Software Modules

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

Databases

In some embodiments, the methods, systems, and media disclosed herein include one or more databases, or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object oriented databases, object databases, entity-relationship model databases, associative databases, and XML, databases. In some embodiments, a database is internet-based. In further embodiments, a database is web-based.

In still further embodiments, a database is cloud computing-based. In other embodiments, a database is based on one or more local computer storage devices.

General Information Relating to Various Embodiments of the Invention

A controller, computing device, or computer, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth by the claims and any equivalents thereto.

The invention claimed is:

1. A system for providing a game at a gaming table, the system including one or more processors, display devices, data input devices, and memory, wherein the display device displays a gaming table layout with a plurality of defined areas, the processor being in communication with a random number generator and configured to, in combination with the random number generator, simulate a custom set of randomly-ordered physical playing cards having a plurality of unique wild cards, wherein executable code in memory is executed to perform the following steps:

display on the one or more display device cards randomly generated by the processor in combination with the random number generator from the simulated set of randomly-ordered playing cards stored in memory to form an initial player hand of randomly generated displayed cards for each participating player;

receive from the one or more data input devices a selection of a plurality of final hands and a hand designation from each player for each final hand of the plurality, each final hand of the plurality comprising at least two cards from the initial player hand and each hand designation being a unique and single designation selected from a preset group of designations, wherein each player's final hands are associated with a single respective hand designation included in the preset group of designations;

wherein the one or more processors (i) determine the rank of each player's final hand;

(ii) compare each player's final hand with a preset point chart based on the determined rank of each final hand;

(iii) compare each player's final hand rank with at least one other player's final hand rank of the same designation, wherein the player having the final hand that is of the highest rank in any designation is identified as the winner of the designation; and (iv) assign a point total for each player based on the comparison of each player's final hand with the preset point chart, wherein each player receives an additional amount of points responsive to being identified as the winner of the designation.

2. A method of providing a game over a communication network, the network being in communication with memory, a processor, a random number generator, a display device and a data input device, the method comprising the steps of:

providing from the memory a gaming table layout on the display device with a plurality of defined areas representing final hand designations in the game;

providing from the memory a custom deck of cards including a standard deck of cards and a plurality of wild cards;

distributing by the processor in communication with the random number generator, randomly generated cards from the set of playing cards stored in the memory to form an initial player hand of random cards for each participating player;

receiving through a data input device a selection of a plurality of final hands and a hand designation from each player for each final hand of the plurality, each final hand of the plurality comprising at least two cards from the initial player hand and each hand designation being a unique and single designation selected from a preset group of designations, wherein each player's final hands are associated with a single respective hand designation included in the preset group of designations;

a processor configured for (i) determining the rank of each player's final hand;

comparing each player's final hand with a preset point chart based on the determined rank of each final hand;

(ii) comparing each player's final hand rank with at least one other player's final hand rank of the same designation, wherein the player having the final hand that is of the highest rank in any designation is identified as the winner of the designation; and (iii) assigning a point total for each player based on the comparison of each player's final hand with the preset point chart, wherein each player receives an additional amount of points responsive to being identified as the winner of the designation.

3. A method for providing a game using one or more processors, display devices, data input devices, and memory, wherein the display device displays a gaming table layout with a plurality of defined areas, the one or more processors being configured to communicate with a random number generator to simulate a custom set of randomly-ordered physical playing cards having a plurality of unique wild cards, the memory storing executable code, the method comprising the following steps:

displaying on the one or more display device cards randomly generated by the processor in combination with the random number generator from the simulated set of randomly-ordered playing cards stored in memory to form an initial player hand of randomly generated displayed cards for each participating player;

receiving from the one or more data input devices a selection of a plurality of final hands and a hand designation from each player for each final hand of the plurality, each final hand of the plurality comprising at least two cards from the initial player hand and each hand designation being a unique and single designation selected from a preset group of designations, wherein each player's final hands are associated with a single respective hand designation included in the preset group of designations;

the one or more processors in combination with the memory:

(i) determining the rank of each player's final hand;

(ii) comparing each player's final hand with a preset point chart based on the determined rank of each final hand;

(iii) comparing each player's final hand rank with at least one other player's final hand rank of the same designation, wherein the player having the final hand that is of the highest rank in any designation is identified as the winner of the designation; and (iv) assigning a point total for each player based on the comparison of each player's final hand with the preset point chart, wherein each player receives an additional amount of points responsive to being identified as the winner of the designation.

* * * * *